US005987679A

United States Patent [19]

Won

[11] Patent Number: 5,987,679

[45] Date of Patent: Nov. 23, 1999

[54] WATER LEVEL SENSING METHOD AND APPARATUS IN WASHING MACHINE

[75] Inventor: Yong-Bok Won, Seoul, Rep. of Korea

[73] Assignee: Daewoo Electronics Co., Ltd., Seoul, Rep. of Korea

[21] Appl. No.: 09/139,728

[22] Filed: Aug. 31, 1998

[30] Foreign Application Priority Data

Aug. 30, 1997 [KR] Rep. of Korea ..... 97-44717

[51] Int. Cl.[6] ..... D06F 33/02

[52] U.S. Cl. ..... 8/158; 8/159; 68/12.04; 68/12.05

[58] Field of Search ..... 8/158, 159; 68/12.04, 68/12.05

[56] References Cited

U.S. PATENT DOCUMENTS

| | | | |
|---|---|---|---|
| 4,303,406 | 12/1981 | Ross | 68/12.05 X |
| 5,072,473 | 12/1991 | Thuruta et al. | 68/12.05 X |
| 5,419,163 | 5/1995 | Kim et al. | 68/12.04 X |
| 5,671,493 | 9/1997 | Moon | 68/12.04 X |
| 5,768,728 | 6/1998 | Harwood et al. | 68/12.05 X |

*Primary Examiner*—Philip R. Coe
*Attorney, Agent, or Firm*—Jacobson, Price, Holman & Stern, PLLC

[57] ABSTRACT

A water level sensing method and apparatus sense a level of water supplied in washing tub of the washing machine. In the apparatus, a key input section generates a water level sensing mode signal so as to select a water level sensing mode. A sensor firstly senses an amount of laundry in a dry state supplied in a washing tub of the washing machine responsive to the water level sensing mode signal from the key input section and secondly senses an amount of the laundry in a wet state. A water supply section supplies the washing tub with water to a predetermined water level to thereby change the washing articles in a dry state into a wet state. A microprocessor determines first and second water levels according to the first and second sensing results of the sensor, respectively, compares the second water level with the first water level and determnines a correct water level based on the comparison result. The method and apparatus can perform a washing operation at suitable water level by sensing an amount of laundry by means of dry and wet sensing manners which sense an amount of loads in dry and wet states, respectively.

7 Claims, 7 Drawing Sheets

WATER LEVEL SENSING METHOD AND APPARATUS IN WASHING MACHINE

BACKGROUND OF THE INVENTION

1. Field of the Invention

The present invention relates to a washing machine, and more particularly, to a method and an apparatus for sensing a level of water supplied in washing tub of the washing machine.

2. Prior Art

In order to determine a water level suitable for washing laundry articles, a water level sensing operation is preferably carried out before performing a washing operation in a washing machine. Generally, the water level sensing operation includes a dry load sensing method which senses washing loads in a dry state without supplying water and a wet load sensing method which senses washing loads in a wet state after supplying water.

U.S. Pat. No. 5,419,163, (issued to Jung H. Kim et al. on May 30, 1995) discloses an apparatus for controlling a washer based on an amount of a washing water, a polluted degree of the washing water, an amount of clothes to be washed, a detergent, and etc.

FIG. 1 illustrates a conventional water level sensing apparatus in a washing machine. The conventional water level sensing apparatus includes a load sensor 102, a water supply section 104, and a microprocessor 106. The load sensor 102 senses a weight of a dry load or a wet load supplied in washing tub 100 of the washing machine under the control of the microprocessor 106. The weight of the dry load or wet load is fed to the microprocessor. The water supply section 104 supplies the washing tub 100 with water under the control of the microprocessor 106. The microprocessor 106 determines a water level based on the weight of the dry load from the load sensor 102. The microprocessor 106 also judges whether or not the water supplied in washing tub 100 has reached the water level determined.

FIG. 2 illustrates a conventional water level sensing method in a washing machine by a dry load sensing manner. In step S201, a load sensor 102 senses a weight of a dry load supplied in washing tub 100 of the washing machine under the control of the microprocessor 106. The weight of the dry load is supplied to the microprocessor 106. The microprocessor 106 receives the weight of the dry load from the load sensor 102 and determines a water level based on the weight of the dry load(step S202).

In step S203, the water supply section 104 starts to supply the washing tub 100 with water under the control of the microprocessor 106. In step S204, the microprocessor 206 judges whether or not the water supplied in washing tub 100 has reached the water level determined in step S202. As a result of the judgement in step S204, when the water supplied in washing tub 100 has not reached the water level determined in step 202, the routine returns to step S203. When it is judged that the water supplied in washing tub 100 has reached the water level determined in step 202, the microprocessor 106 performs a washing operation(step S205).

FIG. 3 is a flow chart for illustrating a conventional water level sensing method in a washing machine by a wet load sensing manner. In step S301, the water supply section 204 starts to supply the washing tub 100 with water under the control of the microprocessor 106. In step S302, the microprocessor 106 judges whether or not the water supplied in washing tub 100 has reached a lowest water level.

As a result of the judgement in step S302, when the water supplied in washing tub 100 has not reached the lowest water level, the routine returns to step S301. When it is judged that the water supplied in washing tub 100 has reached the lowest water level, the load sensor 102 senses a weight of a wet load supplied in washing tub 100 under the control of the microprocessor 106. The weight of the wet load is applied to the microprocessor 106. The microprocessor 106 receives the weight of the wet load from the load sensor 102 and determines a water level based on the weight of the wet load(step S304). In step S305, the water supply section 204 supplies the washing tub 100 with water to the water level determined in step S304 to thereby complete the water supply. Then, the microprocessor 106 performs a washing operation(step S306).

In a conventional water level sensing method in a washing machine, one of a method for sensing loads in dry and wet states is achieved. Therefore, difference between load sensing in dry and wet states greatly occurs. For example, laundry such as a coverlet or a woolen jacket is light in a dry state but heavy in a wet state. Thus, even if sensing a water level with respect to the coverlet or woolen jacket in the wet state is exact, sensing a water level with respect to the coverlet or woolen jacket in the dry state occurs great error.

SUMMARY OF THE INVENTION

Therefore, it is an object of the present invention, for the purpose of solving the above mentioned problems, to provide a method and an apparatus which can perform a washing operation with a suitable water level according to the characteristics of washing articles.

In order to attain the object, according to the present invention, there is provided a water level sensing method in a washing machine, the method comprising the steps of:

(a) firstly sensing an amount of laundry in a dry state supplied to a washing tub of the washing machine according to a selection of a water level sensing mode;

(b) determining a first water level according to the first sensing result of step (a);

(c) supplying the washing tub with water to a predetermined water level to thereby change the laundry into a wet state;

(d) secondly sensing an amount of the washing articles in the wet state;

(e) determining a second water level according to the second sensing result of step (d);

(f) comparing the second water level determined in step (c) with the first water level determined in step (f); and (h) determining a correct water level based on the comparison of step (f).

Also, there is provided a water level sensing apparatus in a washing machine, the apparatus comprising a key input section for generating a water level sensing mode signal so as to select a water level sensing mode;

a sensor for firstly sensing an amount of laundry in a dry state supplied in a washing tub of the washing machine responsive to the water level sensing mode signal from the key input section and secondly sensing an amount of the laundry in a wet state;

a water supply section for supplying the washing tub with water to a predetermined water level to thereby change the washing articles in a dry state into a wet state;

a microprocessor for determining first and second water levels according to the first and second sensing results of the sensor, respectively, comparing the second water level with the first water level and determining a correct water level based on the comparison result.

According to the present invention, the method and apparatus can perform a washing operation at suitable water level by sensing an amount of laundry by means of dry and wet sensing manners which sense an amount of loads in dry and wet states, respectively.

Other objects and further features of the present invention will become apparent from the detailed description when read in conjunction with the attached drawings.

BRIEF DESCRIPTION OF THE DRAWINGS

Other features and advantages of the present invention will become more apparent from the following description taken in connection with the accompanying drawings, wherein.

DETAILED DESCRIPTION OF THE PREFERRED EMBODIMENT

Figure 1:
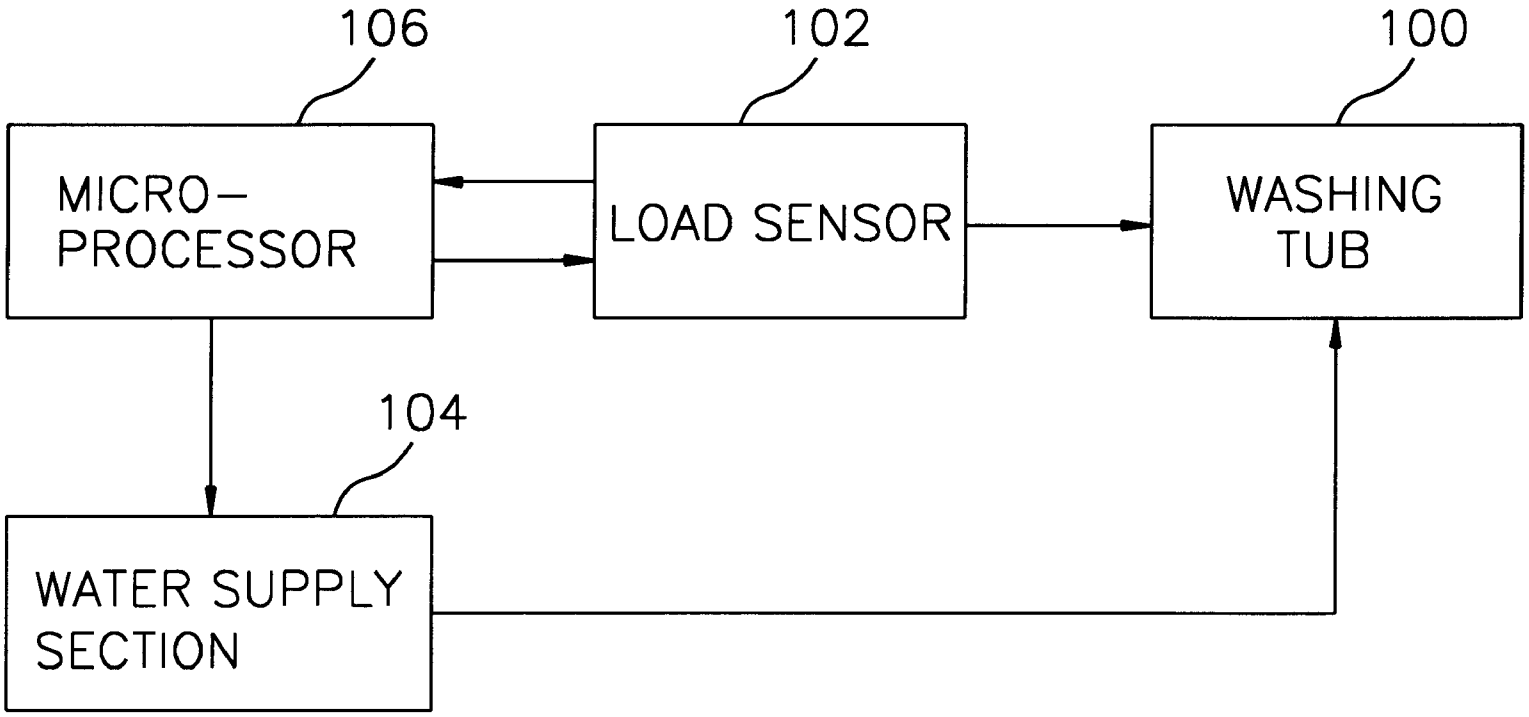
FIG. 1 PRIOR ART
FIG. 1 is a block diagram for showing a conventional water level sensing apparatus.
Figure 2:
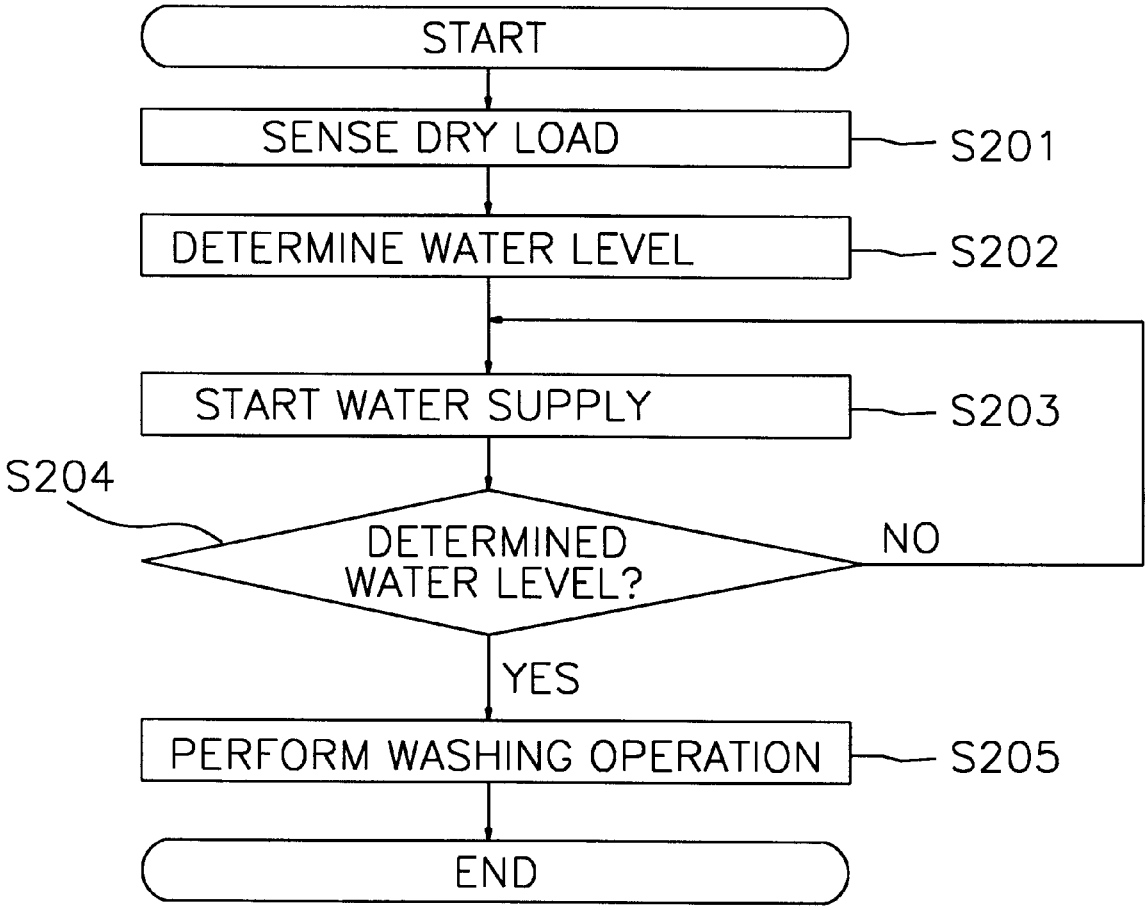
FIG.2 PRIOR ART
FIG. 2 is a flow chart for illustrating a conventional water level sensing method in a washing machine by a dry load sensing manner.
Figure 3:
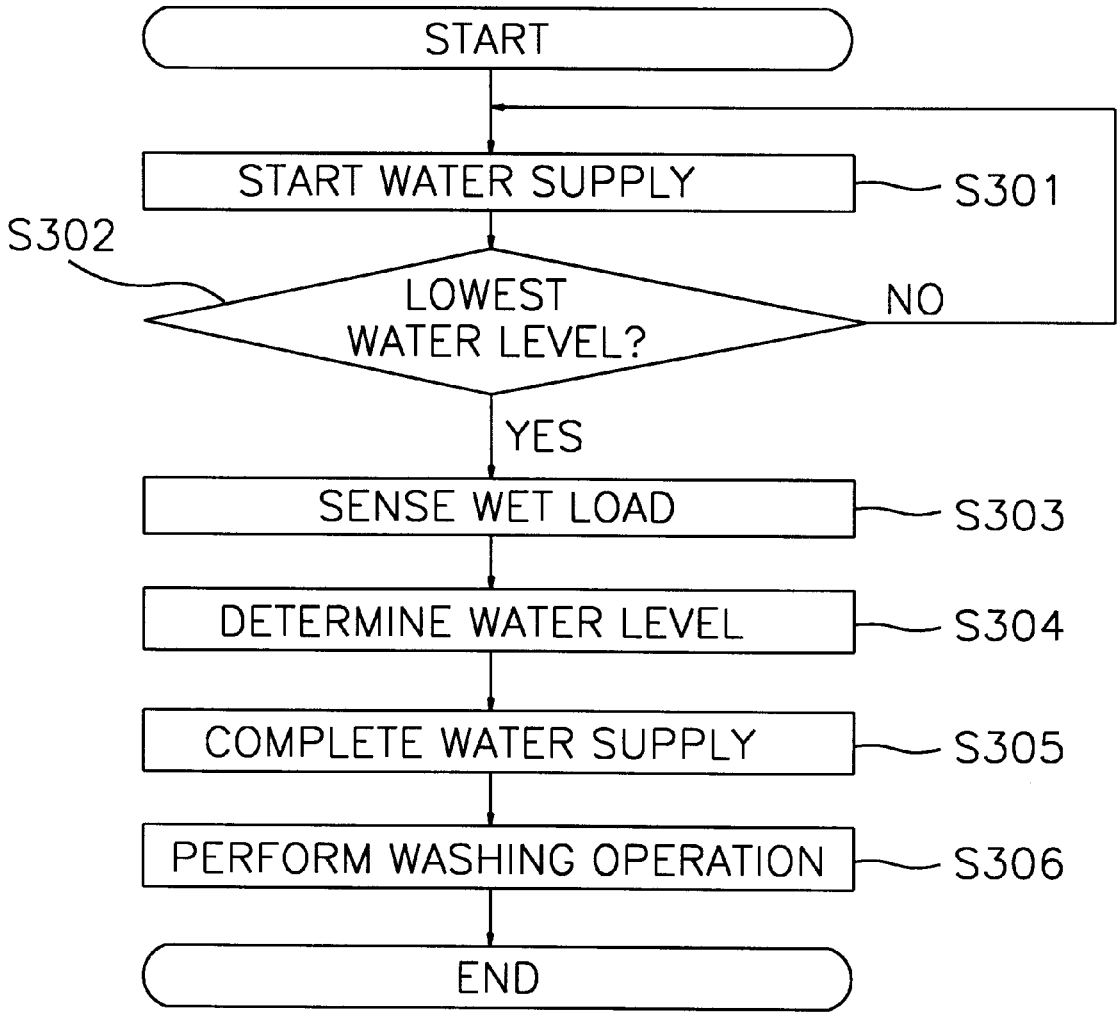
FIG.3 PRIOR ART
FIG. 3 is a flow chart for illustrating a conventional water level sensing method in a washing machine by a wet load sensing manner.

The preferred embodiment of the present invention will hereinafter be described in detail with reference to the accompanying drawings.

The apparatus includes a key input section 404, a sensor 406, a water supply section 408, and a microprocessor 410.

The key input section 404 generates a water level sensing mode signal WL so as to select a water level sensing mode. The water level sensing mode signal WL is applied to the microprocessor 410.

The sensor 406 firstly senses an amount of laundry to be washed in a dry state supplied in a washing tub 400 of the washing machine responsive to the water level sensing mode signal WL from the key input section 404. The sensor 406 also secondly senses an amount of the laundry in the wet state. The sensor 406 includes a motor 406*a*, a motor controller 406*b*, a photo coupler 406*c*, and a analog/digital (A/D) converter 406*d*.

Figure 4:
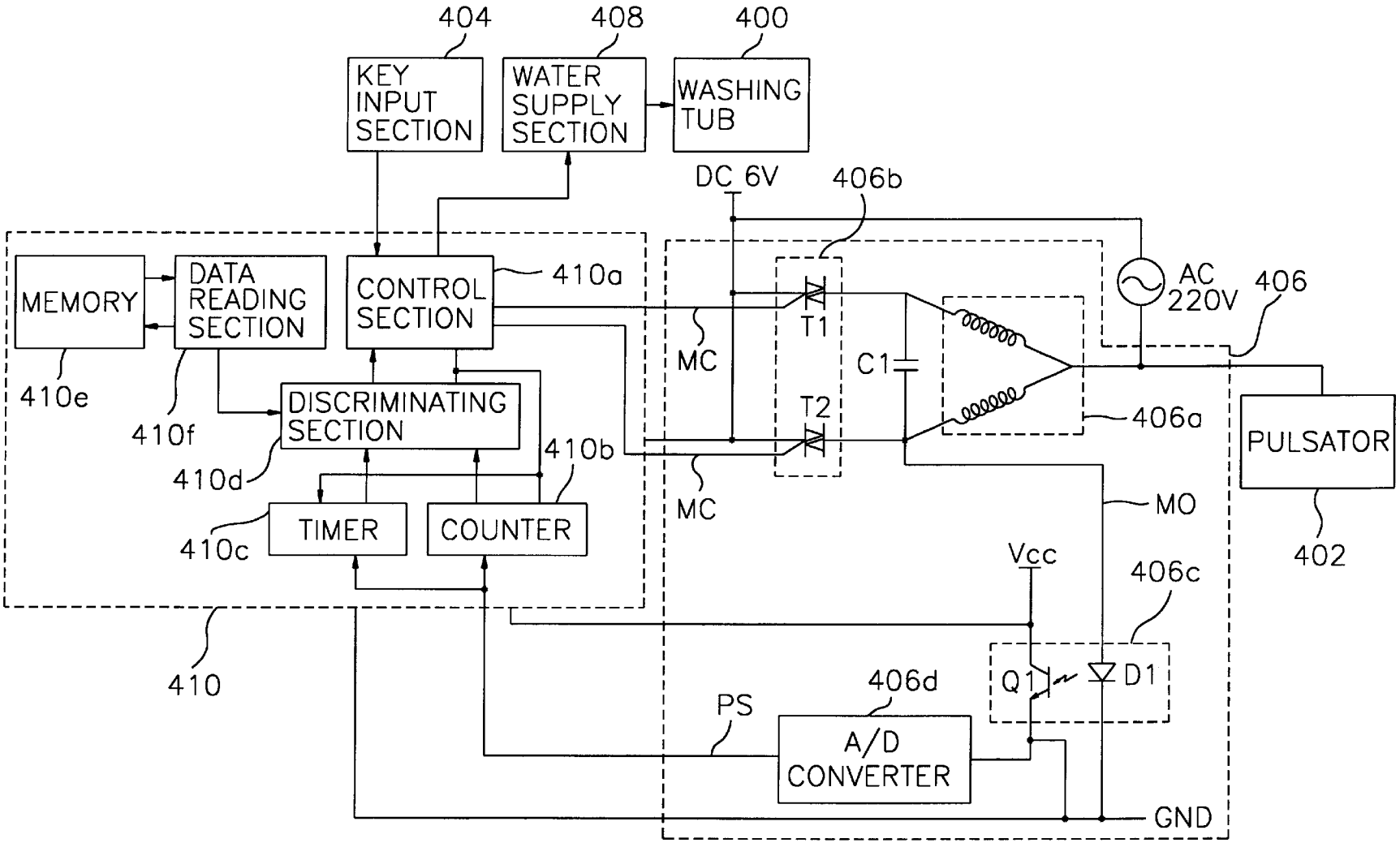
FIG. 4 is a view for showing a configuration of the water level sensing apparatus in a washing machine according to an embodiment of the present invention.
Figures 5A, 5B, 5C, 5D:
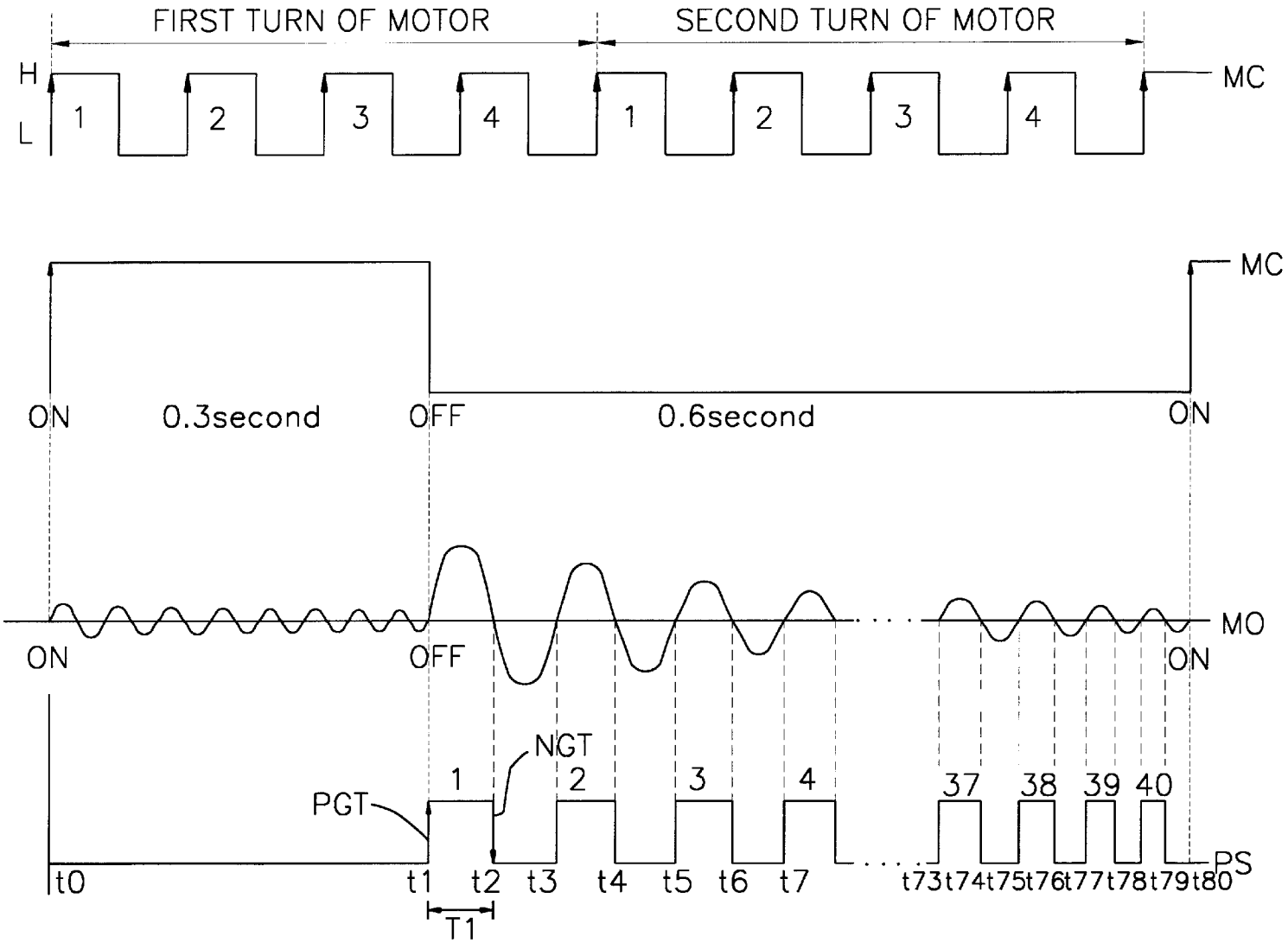
FIGS. 5A to 5D are a timing chart for illustrating an operation of the water sensing apparatus shown in FIG. 4.

FIGS. 5A to 5D are a timing chart for illustrating an operation of the water sensing apparatus shown in FIG. 4. The motor 406*a* is rotated responsive to a motor control signal MC from the microprocessor 410 and generates an output signal MO according to an electromotive force thereof when the motor 406*a* is paused at time t1. The output signal MO of the motor 406*a* is a sine wave signal having different widths as shown in FIG. 5C.

The number of sine waves of the sine wave signal is varied depending on the weight of washing loads. The output signal MO of the motor 406*a* is applied to a photo coupler 406*b*. The motor 406*a* is alternately rotated in the forward and backward directions to cause forward and backward rotations of the pulsator 402. In accordance with a preferred embodiment of the present invention, in the course of each of the forward and reverse direction rotations, the motor 406*a* is repeatedly subjected to on/off control to cause the pulsator 402 to periodically rotate and pause in each direction. The periodic repetition of the rotation and pause states of the pulsator is performed for N number of times whenever the rotation direction is reversely changed where N is a positive integer(N=1,2,3, . . . ). The number N is preferably from 2 to 4. The rotation of the pulsator is achieved by turning the motor 406 on for a time period of about 0.2 to 0.4 second, preferably, 0.3 second. The periodic pause state between rotations of the pulsator 402 is employed to settle down the washing articles which have been agitated during the rotation of the pulsator 402 and may be continued for a time period ranging from about 0.3 to 1 second, preferably, 0.6 second. That is, the on/off operation period of the monitor 406*a* is preferably 0.3 second/0.6 second as shown in FIG. 5C.

A motor controller 406*b* receives power from an AC power source and selectively couples and decouples the AC power to motor 406 responsive to commands from the microprocessor. The motor controller 406*b* includes first and second triacs T1 and T2. The photo coupler 406*c* emits a light responsive to the output signal MO of the motor 406*a*. The photo coupler 406*c* includes a diode D1 and a transistor Q1. When the output signal MO of the motor 406*a* is in a high level, the diode D1 becomes a conductive state and thus emits light. The transistor Q1 is provided which receives the light emitted from the diode D1. The A/D converter 406*d* is connected to an emitter of the transistor Q1 and converts the amount of received light into a digital signal, that is, the pulse signal PS shown in FPG. 5D.

The water supply section 408 supplies the washing tub 400 with water under the control of the control section 410*a* to a predetermined water level to thereby change the washing articles into a wet state.

The microprocessor 410 determines first and second water levels A1 and A2 according to the first and second sensing results of the sensor 406, respectively. The microprocessor 410 also compares the second water level A2 with the first water level A1 and determines a correct water level based on the comparison result. The microprocessor 410 includes a control section 410*a*, a counter 410*b*, a timer 410*c*, and a determining section 410*d*. The control section 410*a* generates a motor control signal MC in response to the water level sensing mode signal WL from the key input section 404 and controls the operation of the water supply section 408. The motor control signal MC is a signal which generates four pulses every one turn of the motor 406*a*. The each pulse of the motor control signal MC has 0.3 second interval high level and 0.6 second interval low level, as shown in FIG. 5A. The motor control signal MC is applied to motor 406*a*.

The counter 410*b* counts the pulse signal from the A/D converter 406*d*. The timer 410*c* detects a timer interval T1 of one pulse of the pulse signal PS from the AID converter 406*d*. The discriminating section 410*d* determines the first and second water levels A1 and A2 based on the number of pulses of the pulse signal PS counted by the counter 410*b*, the time interval T1 detected by the timer 410*c*, and reference data. The discriminating section 410*d* judges whether or not the first and second determined water levels A1 and A2 coincide with each other and determines the correct water level according to a result of the judgement.

The microprocessor 410 further includes a memory 410*e* for storing reference data for judging a water level in dry and wet states. Table 1 is one example of the reference data for judging a water level in dry state experimentally obtained. For example, when the weight of the washing load in a dry state is 1.8, the number of pulses of the pulse signal is 56(38). Thus, the first level is a lowest level. The microprocessor 410 further includes a data reading section 410*f* for reading out the reference data stored in the memory 410*e* and providing the read reference data to the discriminating section 410*d*.

Figure 6A:
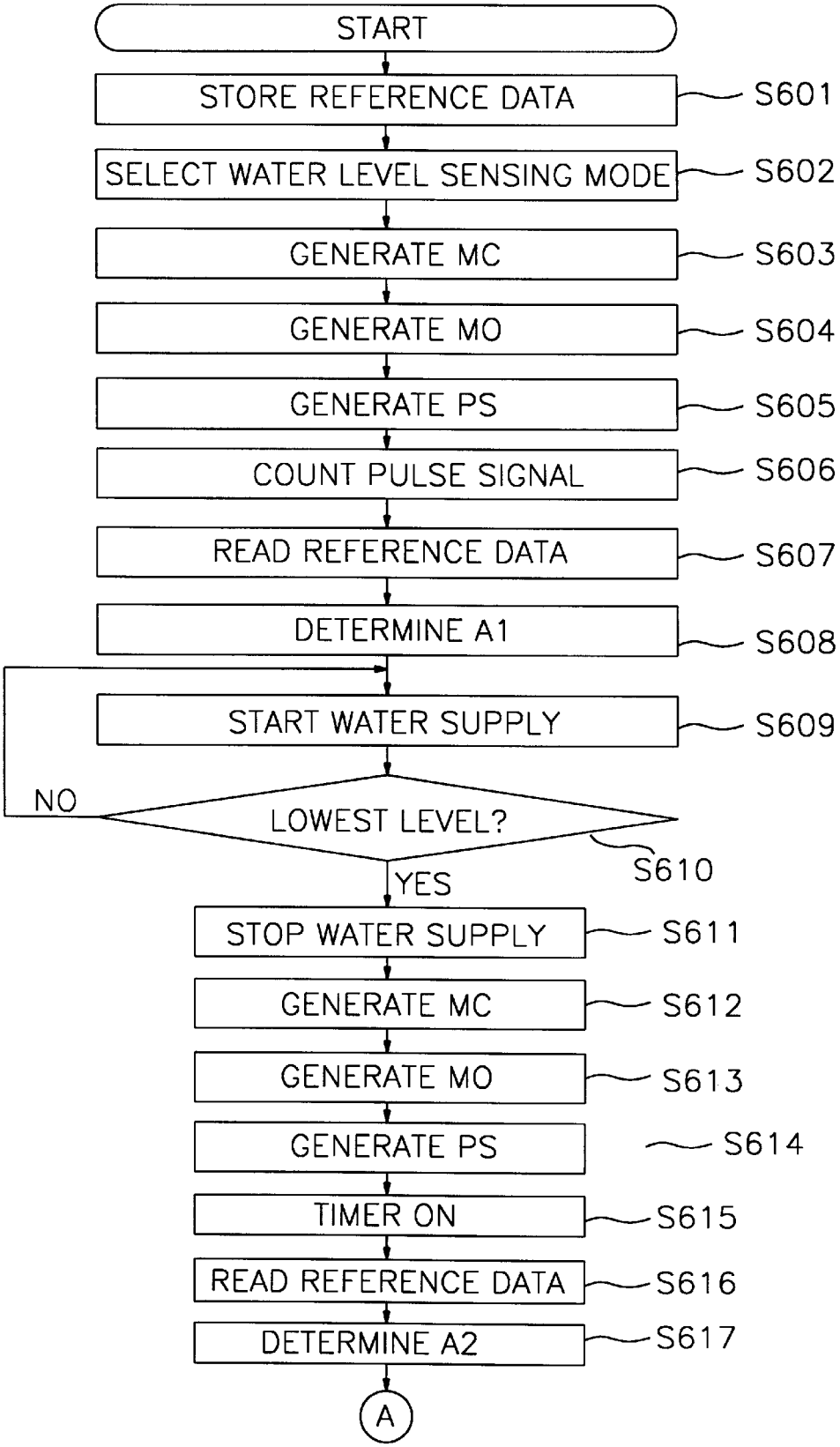
FIGS. 6A and 6B is a flow chart for illustrating a water level sensing method in a washing machine according to an embodiment of the present invention.
Figure 6B:
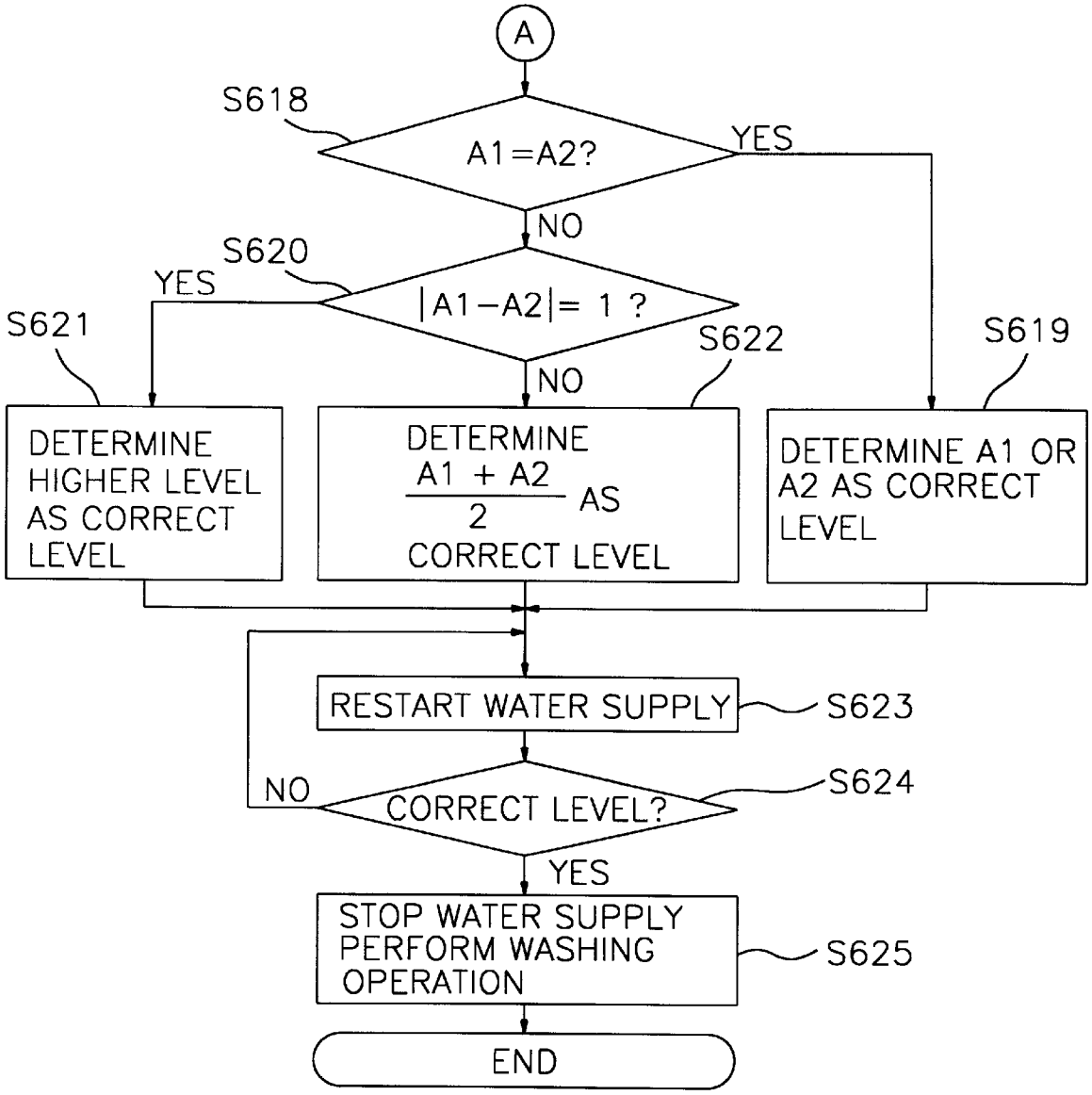

A detailed description of the operation of the present invention will be given below with reference to the flow chart of FIGS. 6A and 6B. FIGS. 6A and GB illustrate a water level sensing method in a washing machine according to an embodiment of the present invention.

Before sensing a water level, the memory 402 stores reference data for judging water level in dry and wet states under the control of the control section 410*a* of the microprocessor 410(step S601). One example of the reference data is illustrated in Table 1. When a user selects a fuzzy course, that is, a water level sensing mode by pushing a start/pause button of a key input section 404 after washing articles to be washed have been poured in a washing tub 400 of a washing machine, the key input section 404 outputs a water level sensing mode signal WL to a control section 410*a* of the microprocessor 410(step S602). The control section 410*a* generates a motor control signal MC in response to the water level sensing mode signal WL from the key input section 404(step S603). As shown in FIG. 5A, the motor control signal MC has four pulses every one turn of the motor 406*a*. Each pulse of the motor control signal MC has 0.3 second interval high level and 0.6 second interval low level. The motor control signal MC is applied to motor controller 406*b*.

Then, the motor controller 406*b* receives power from an AC power source and selectively couples and decouples the AC power to motor 406*a* responsive to the motor control signal MC from

TABLE 1

| WATER LEVEL | LOAD (kg) | THE NUMBER OF PULSES 1 | 2 | 3 | 4 | 5 |
|---|---|---|---|---|---|---|
| LOWEST | 0.0 | 48 | 48 | 48 | 48 | 48 |
| LEVEL | 0.3 | 44 | 44 | 48 | 49 | 49 |
| | 0.6 | 40 | 41 | 40 | 40 | 41 |
| | 0.9 | 3E | 3E | 3E | 3E | 3.E |
| | 1.2 | 3C | 3D | 3C | 3C | 3D |
| LOWER | 1.5 | 3A | 38 | 39 | 38 | 38 |
| LEVEL | 1.8 | 38 | 37 | 37 | 37 | 38 |
| | 2.1 | 35 | 36 | 36 | 35 | 36 |
| | 2.5 | 34 | 35 | 33 | 34 | 34 |
| MIDDLE | 2.7 | 33 | 34 | 33 | 32 | 33 |
| LEVEL | 3.0 | 30 | 33 | 30 | 31 | 33 |
| | 3.3 | 30 | 31 | 30 | 31 | 32 |
| | 3.5 | 2E | 2C | 2E | 30 | 2F |
| | 3.9 | 2C | 2D | 2C | 2D | 2E |
| HIGHER | 4.2 | 2C | 2B | 2B | 2C | 2C |
| LEVEL | 4.5 | 2A | 2A | 2C | 2B | 2C |
| | 4.8 | 2A | 2A | 29 | 2A | 29 |
| | 5.1 | 2A | 28 | 28 | 2A | 2A |
| | 5.5 | 26 | 28 | 26 | 28 | 28 |
| HIGHEST | 5.7 | 26 | 25 | 24 | 25 | 25 |
| LEVEL | 6.0 | 26 | 26 | 25 | 25 | 25 |

the control section 410*a*. Thus, the motor 406*a* is rotated responsive to the motor control signal MC from the control section 410*a* at time t0 and generates an output signal MO according to the electromotive force thereof when it stops at time t1(step S604). At this time, the on/off operation period of the motor 408 is 0.3 second/0.6 second as shown in FIG. 5C. The output signal MO of the motor 400 is applied to the photo coupler 406*c*.

When the output signal MO of the motor 406*a* is in a high state, the diode D1 of the photo coupler 406*c* becomes a conductive state and thus emits light. The transistor Q1 of the photo coupler 406*c* is provided which receives the light emitted from the diode D1. The light from the transistor Q1 is applied to A/D converter 406*d*. The A/D converter 406*d* converts the amount of received light into a pulse signal PS shown in FIG. 5D(step S605). The pulse signal PS of the A/D converter 406*d* is applied to the counter 410*b* of the microprocessor 410. The counter 410*b* counts the pulse signal PS from the A/D converter 406*d* (step S606). The data reading section 410*f* of microprocessor 410 reads the reference data for judging a water level in a dry state which are stored in the memory 410*e* (step S607). The reference data read in the data reading section 410*f* are supplied to the discriminating section 410*d* of the microprocessor 410.

The discriminating section 410*d* determines a first water level A1 based on the number of pulses of the pulse signal PS counted by the counter 410*b* and the read reference data from the data reading section 410*f* and generates a discriminating result signal DR(step S608). The discriminating result signal DR from the discriminating section 416*d* is applied to the control section 410*a*. The control section 410*a* according to the discriminating result signal DR from the discriminating section 416*e* controls water supply section 408 to start to supply the washing tub 400 with water(step S609).

The discriminating section 410*d* judges whether or not the water supplied in the washing tub 400 has reached a lowest water level(step S610). As the result of the judgement in step S610, when the water supplied to the washing tub 400 has not reached the lowest water level, the routine returns to step S609. When it is judged that the water supplied in the washing tub 400 has reached the lowest water level, the water supply section 408 stops water supply under the control of the control section 410*a* (step S611). Then the control section 410*a* generates a motor control signal MC(step S612). The motor control signal MC is applied to motor controller 406*b*. Then, the motor controller 406*b* receives power from an AC power source and selectively couples and decouples the AC power to motor 408 responsive to the motor control signal MC from the control section 410*a*. Thus, the motor 406*a* is rotated responsive to the motor control signal MC from the control section 410*a* and generates an output signal MO according to the electromotive force of the motor 406*a* when the motor 406*a* pauses as illustrated in step S604(step S613). The output signal MO of the motor 408 is applied to the photo coupler 406*c*.

When the output signal MO of the motor 406*a* is in a high level, the diode D1 of the photo coupler 406*c* becomes a conductive state and thus emits light. The transistor Q1 is provided which receives the light emitted from the diode D1.

The A/D converter 406*d* converts the amount of received light into the pulse signal PS shown in FIG. 5D(step S614). The pulse signal PS of the A/D converter 406*d* is applied to the timer 410*c* of the microprocessor 410. In step S615, the timer 410*c* turns on responsive to the pulse signal PS from the A/D converter 406*d* at time t1 when a first positive-going transition (PGT) of the pulse signal PS occurs, turns off at time t2 when the first negative-going transition(NGT) thereof occurs, and detects a time interval T1 of one pulse of the pulse signal PS from time t1 to time t2, under the control of the control section 410*a*.

The data reading section 410*e* reads the reference data for judging a water level in a wet state which are stored in the memory 410*e* (step S616). The reference data read in the data reading section 410*f* are the discriminating section 410*d* of the microprocessor 410. The discriminating section 410*d* determines a second water level A2 based on the time interval T1 of one pulse of the pulse signal PS detected by the timer 410*c* and the read reference data for judging a water level in a wet state from the data reading section 410*f*(step S617).

In step S618, the discriminating section 410*d* judges whether or not the first water level A1 determined in step S607 and the second water level A2 determined in step S616 coincide with each other. As the result of the judgement in step S618, when the first water level A1 and second water level A2 coincide with each other, the discriminating section 410*d* determines the first water level A1 or the second water level A2 as a correct water level(step S619). When it is judged that the first and second water levels A1 and A2 are different from each other, the discriminating section 410*d* judges whether or not an absolute value of a difference between the first and second water levels A1 and A2 is one(step S620).

As the result of the judgement in step S620, when the absolute value of the difference between the first and second water levels A1 and A2 is one, the discriminating section 410*d* determines a higher one between the first and second water levels A1 and A2 as the correct water level(step S621). When it is judged that the difference between the first and second water levels A1 and A2 is greater than one, the discriminating section 410*d* determines a middle between the first and second water levels A1 and A2 as the correct water level(step S622).

After the correct water level is determined in step S619, step S621, or step S622, the water supply section 408 restarts to supply the washing tub 400 with water under the control of the control section 410*a* (step S623). In step S624, the discriminating section 410*d* judges whether or not the water supplied in the washing tub 400 reaches the correct water level determined in one among step S619, step S621, and step S622. As the result of the judgement in step S624, when the water supplied in the washing tub 400 has not reached the correct water level, the routine returns to step S623. When it is judged that the water supplied in the washing tub 400 has reached the correct water level, the water supply section 408 stops the water supply under the control of the control section 410*a* and the control section 410*a* performs a washing operation(step S625).

As mentioned above, the present invention can perform a washing operation at suitable water level by sensing an amount of laundry by means of dry and wet sensing manners which sense an amount of loads in dry and wet states, respectively.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A water level sensing method in a washing machine, said method comprising the steps of:

(a) firstly sensing an amount of laundry in a dry state supplied to a washing tub of the washing machine according to a selection of a water level sensing mode;

(b) determining a first water level according to the first sensing result of step (a);

(c) supplying the washing tub with water to a predetermined water level to thereby change the laundry into a wet state;

(d) secondly sensing an amount of the washing articles in the wet state;

(e) determining a second water level according to the second sensing result of step (d);

(f) comparing the second water level determined in step (c) with the first water level determined in step (f); and (h) determining a correct water level based on the comparison of step (f).

2. The method as recited in claim 1, wherein step (a) includes (a-1) selecting the water level sensing mode; (a-2) generating a first motor control signal according to the selection of the water level sensing mode of step (a-1), (a-3) rotating a motor responsive to first the motor control signal and generating a first output signal according to an electromotive force of the motor when the motor pauses after a predetermined time, (a-4) converting the first output signal of the motor into a first pulse signal, and (a-5) counting the first pulse signal of step (a-4); and step (b) includes determining the first water level based on the number of pulses of the first pulse signal counted in step (a-5) and first reference data.

3. The method as recited in claim 1, wherein step (d) includes (d-1) judging whether the water supplied in the washing tub has reached a lowest level, (d-2) stopping water supply and generating a second motor control signal when the water supplied in the washing tub has reached the lowest level, (d-3) rotating the motor responsive to the second motor control signal and generating a second output signal according to an electromotive force of the motor when the motor pauses after a predetermined time, (d-4) converting the second output signal of the motor into a second pulse signal, and (d-5) detecting a time interval of a first pulse of the second pulse signal; step (e) determining a second water level based on the time interval of one pulse of the second pulse signal detected in step (d-4) and second reference data.

4. The method as recited in claim 1, wherein step (g) includes determining the first or second water level as the correct water level when the first and second water levels determined in steps (b) and (e) coincide with each other;

determining a higher level between the first and second water levels as the correct water level when an absolute value of a difference between the two levels is one; and determining a middle level between the first and second water levels as the correct water level when the absolute value of a difference between the two levels is greater than one.

5. A water level sensing apparatus in a washing machine, said apparatus comprising a key input section for generating a water level sensing mode signal so as to select a water level sensing mode;

a sensor for firstly sensing an amount of laundry in a dry state supplied in a washing tub of the washing machine responsive to the water level sensing mode signal from the key input section and secondly sensing an amount of the laundry in a wet state;

a water supply section for supplying the washing tub with water to a predetermined water level to thereby change the washing articles in a dry state into a wet state;

a microprocessor for determining first and second water levels according to the first and second sensing results of the sensor, respectively, comparing the second water level with the first water level and determining a correct water level based on the comparison result.

6. The apparatus as recited in claim 5, wherein the sensor includes a motor rotated responsive to an input motor control signal for generating an output signal according to an electromotive force of the motor generated when the motor pauses after a predetermined time, a motor controller for receiving power from a power source and selectively coupling and decoupling the power source to the motor responsive to the input motor control signal, a photo coupler for emitting a light responsive to the output signal of the motor, and an analog/digital converter for receiving the light from the photo coupler and converting an amount of the received light into a pulse signal; and a microprocessor includes a control section for generating a motor control signal responsive to the water level sensing mode signal from the key input section and controlling the water supply operation of the water supply section, a counter for counting the pulse signal from the analog/digital converter, a timer for detecting a time interval of one pulse of the pulse signal from the analog/digital converter, a discriminating section for determining the first and second water levels based on the number of pulses of the pulse signal counted by the counter, the time interval detected by the timer, and reference data, and for judging whether the first and second determined water levels coincide with each other and determining the correct water level according to a result of the judgement.

7. The apparatus as recited in claim 5, further comprising a memory for storing the reference data and a data reading section for reading the reference data stored in the memory and providing the reference data to the discriminating section.

* * * * *